US006575811B1

(12) United States Patent
Fildan et al.

(10) Patent No.: US 6,575,811 B1
(45) Date of Patent: Jun. 10, 2003

(54) ZIP WIRE BRASSIERE

(75) Inventors: Gerhard Fildan, Vienna (AT); Karl Wanzenböck, Leobersdorf (AT)

(73) Assignee: Fildan Accessories Corporation, Humble, TX (US)

( * ) Notice: Subject to any disclaimer, the term of this patent is extended or adjusted under 35 U.S.C. 154(b) by 0 days.

(21) Appl. No.: 10/047,930

(22) Filed: Jan. 15, 2002

(51) Int. Cl.[7] ..... A41C 3/00
(52) U.S. Cl. ..... 450/41
(58) Field of Search ..... 450/41, 45, 47, 450/51, 52, 53, 36, 37, 86, 88; 2/73, 78.1, 255–259, 263, 264; 24/528, 591.1, 593.1, 587

(56) References Cited

U.S. PATENT DOCUMENTS 230,462 A 7/1880 Bortree
3,203,424 A * 8/1965 Garutso ..... 450/37
3,489,153 A * 1/1970 Gaisser ..... 450/88
4,222,387 A 9/1980 Tetu
4,269,191 A 5/1981 Evans
5,938,500 A 8/1999 Hampton
6,431,946 B1 * 8/2002 Fildan et al. ..... 450/41

* cited by examiner

*Primary Examiner*—Gloria M. Hale
(74) *Attorney, Agent, or Firm*—Herbert Dubno

(57) ABSTRACT

A push and zip wire system of a brassiere has an underwire head forming member on the underside of each cup which can slide into a channel on the respective cup receiving portion of the frame. The channel is formed at its end remote from the mind section of the frame with a strap docking arrangement enabling the shoulder strap to engage the underwire assembly directly.

20 Claims, 6 Drawing Sheets

FIG. 9
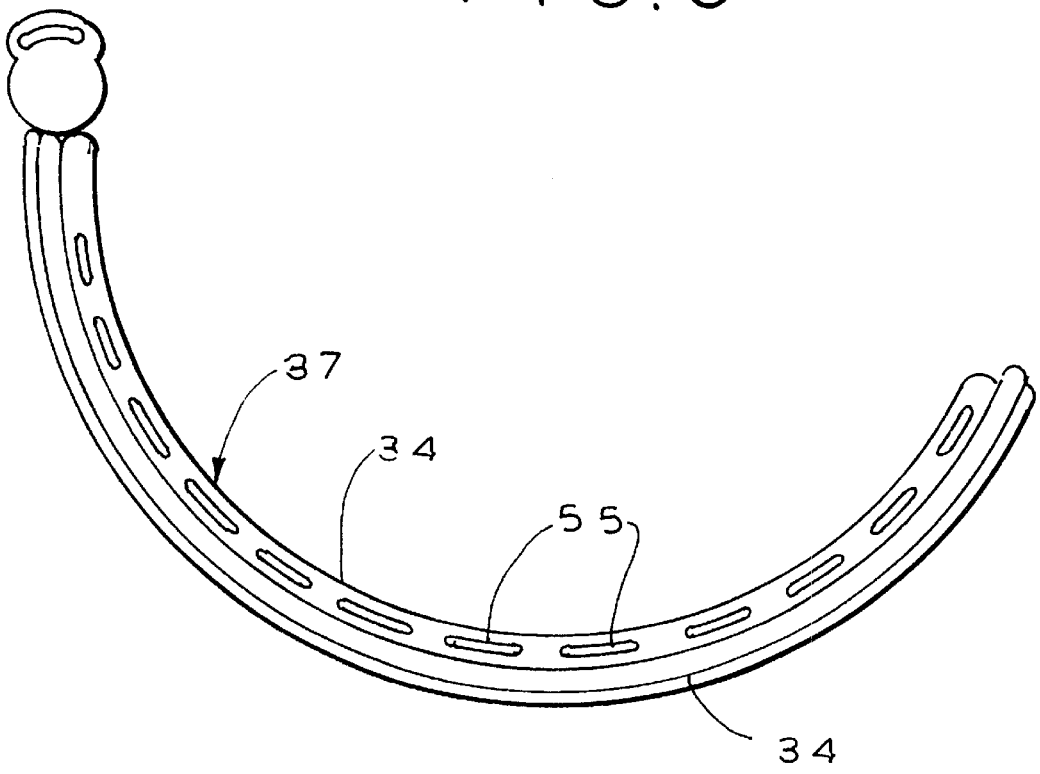
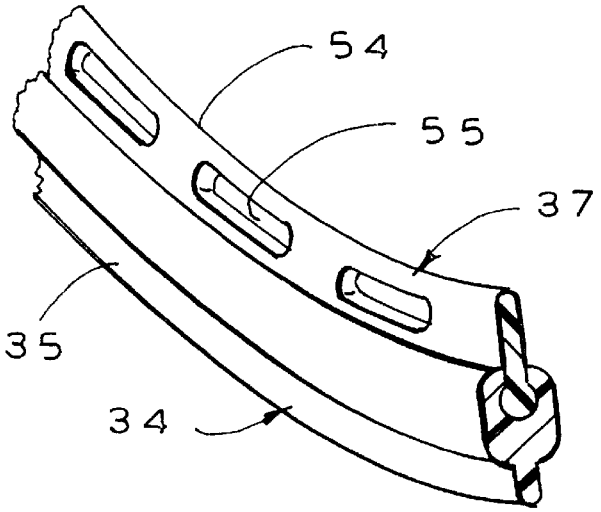
FIG. 10

ZIP WIRE BRASSIERE

FIELD OF THE INVENTION

Our present invention relates to a zip wire brassiere of the type in which brassiere cups can be inserted onto and removed from a frame by engaging an edge of the cup in a wire on the frame of the brassiere.

BACKGROUND OF THE INVENTION

In our application Ser. No. 09/816,786 filed Mar. 23, 2001 now U.S. Pat. No. 6,431,946, we have disclosed various embodiments of underwire assemblies for brassieres, including a system whereby cups of a brassiere can be attached to a frame and thus can be replaceable or interchangeable with respect to the frame and with respect to one another.

Another system in which an underwire assembly can serve for mounting cups is that which is described in U.S. Pat. No. 5,938,500.

With respect to such systems, the construction of the channel which forms the more rigid part of the wire assembly and is provided on the frame poses a problem, especially when the channel is injection molded since conventional molding techniques have required that a core be removed by an arcuate motion to release the molded product. Mold constructions for such purposes are expensive and prone to failure and the molding process is time consuming, expensive and frequently unreliable.

Underwire brassieres, moreover, frequently have the drawback that the cup tends to be distorted by the upward forces on shoulder straps which are attached to the cup.

Accordingly, underwire brassieres in general and underwire brassiere assemblies which have portions of the underwire in the cup engageable in channels on the brassiere frame can be significantly improved.

OBJECTS OF THE INVENTION

It is the principal object of the present invention to provide an improved underwire brassiere whereby drawbacks of earlier systems are obviated.

Another object of this invention is to solve the problem of cup distortion resulting from tension on a shoulder strap of a brassiere.

It is also an object of this invention to provide an improved method of making a brassiere.

SUMMARY OF THE INVENTION

We have discovered that problems of the type mentioned previously can be eliminated in an improved docking system for connecting a shoulder strap to a brassiere wherein the shoulder strap instead of being anchored to the brassiere cup, is connected to the underwire and, in particular, to the channel of the underwire in a brassiere of the type in which the cup has a relatively stiff edge engaging in that channel.

More particularly, the brassiere of the invention has a frame in which the cup-receiving fabric portions are provided with respective channels and the ends of these channels remote from the mid-section of the frame are connected to links for the respective shoulder straps. As a result, upward forces on the shoulder straps are applied to the underwires beneath the cups and thereby lift rather than distort the cups and the breasts of the user received therein.

The invention also comprises a method whereby the channel is formed by injection molding of two channel parts which are then ultrasonically welded together, thereby eliminating the need to withdraw a core in the course of an injection molding process along an arcuate path.

More particularly, the invention can comprise:

a frame having a pair of upwardly concave cup-receiving portions of flexible material joined together at a mid-section of the frame;

a respective upwardly concave curved channel of greater rigidity than the material attached to the frame and extending along each of the upwardly concave cup-receiving portions;

a respective brassiere cup formed with a curved underwire slidably insertable in the respective channel, each underwire and the respective channel being shaped to resist transverse separation forces; and a respective shoulder strap can be connected to each of the cup-receiving portions at the respective channel.

Each of the channels can then be provided with a shoulder strap link at an end remote from the mid-section and this link can be a press button which has a split mole formation which is pressed into an eye on the channel. The press button link forms a unique docking system for the strap such that the forces on the strap are applied to the frame and are distributed by the respective channel or underwire to the underside of the cup.

The underwires can be formed with members somewhat less rigid than the channel and provided with sewing flanges whereby these members can be stitched to the cup fabric and can form the rigid lower edges of the cup.

Alternatively, the brassiere can comprise:

a frame having a pair of upwardly concave cup-receiving portions of flexible material joined together at a mid-section of the frame;

a respective upwardly concave curved channel of greater rigidity than the material attached to the frame and extending along each of the upwardly concave cup-receiving portions; and a respective brassiere cup formed with a curved underwire slidably insertable in the respective channel, each underwire and the respective channel being shaped to resist transverse separation forces, each of the channels comprising a pair of arcuate parts ultrasonically welded together.

The method of making the brassiere can comprise:

forming a frame having a pair of upwardly concave cup-receiving portions of flexible material joined together at a mid-section of the frame;

molding a pair of arcuate parts and ultrasonically welding the parts of each pair of parts together to form a respective upwardly concave curved channel of greater rigidity than the material, and attaching the respective channel to the frame along each of the upwardly concave cup-receiving portions; and providing a respective brassiere cup with a curved underwire slidably insertable in the respective channel, each underwire and the respective channel being shaped to resist transverse separation forces.

BRIEF DESCRIPTION OF THE DRAWING

The above and other objects, features, and advantages will become more readily apparent from the following description, reference being made to the accompanying drawing in which:

FIG. 9 is an elevational view of the assembly after insertion of the cup member into the channel; and FIG. 10 is a perspective view of a portion of that assembly.

SPECIFIC DESCRIPTION

Figure 1:
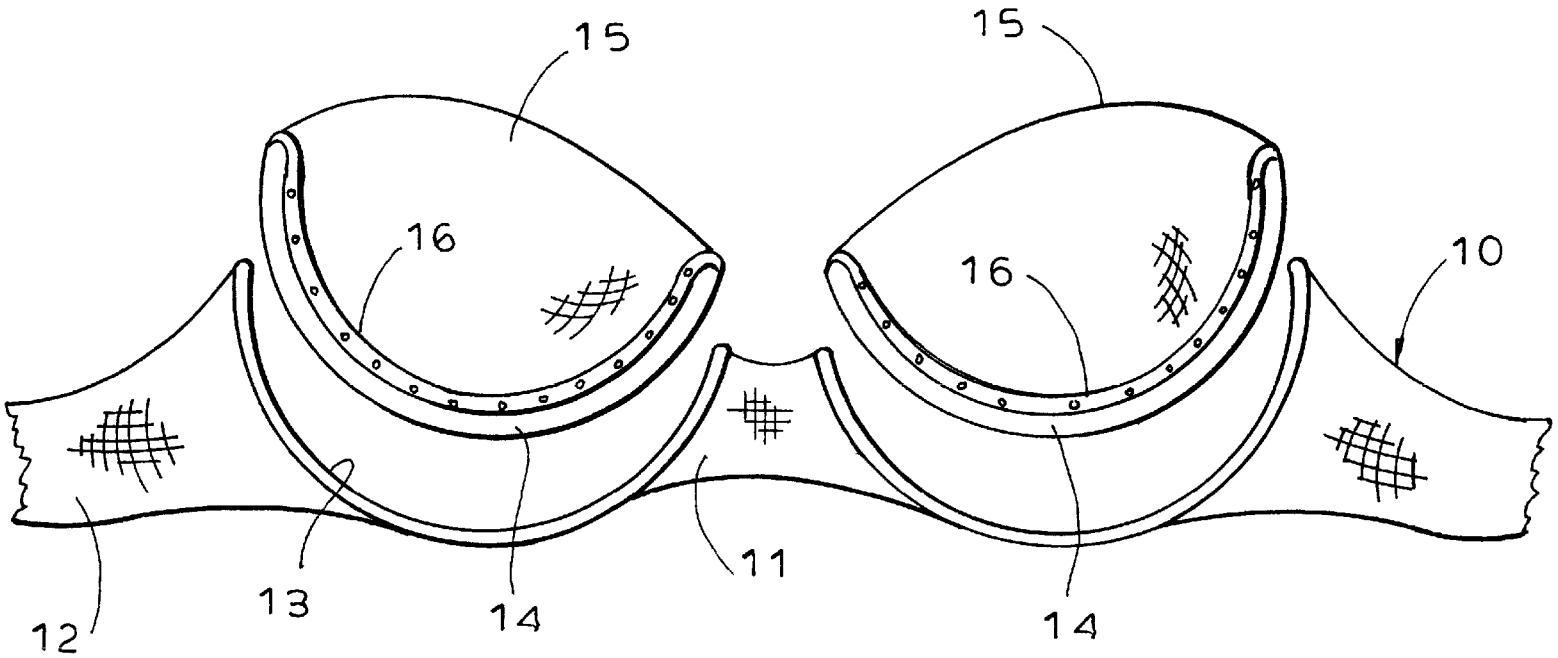
FIG. 1 is an exploded view showing a zip cup brassiere according to the invention utilizing a soft frame construction as described in the aforementioned copending application.

In FIG. 1, we show a brassiere 10 which comprises a so-called soft frame 11 in which the brassiere fabric 12 is formed with a pair of concave beads 13 which are received in channels 14 of respective hard cups 15 in which those channels are stitched to the fabric of the cup by stitching through the respective sewing flanges 16 indicated diagrammatically in FIG. 1. This construction has been illustrated in the above mentioned copending application and details of the underwire assembly construction have been given there as well. This application is hereby incorporated herein by reference in its entirety.

Figure 2:
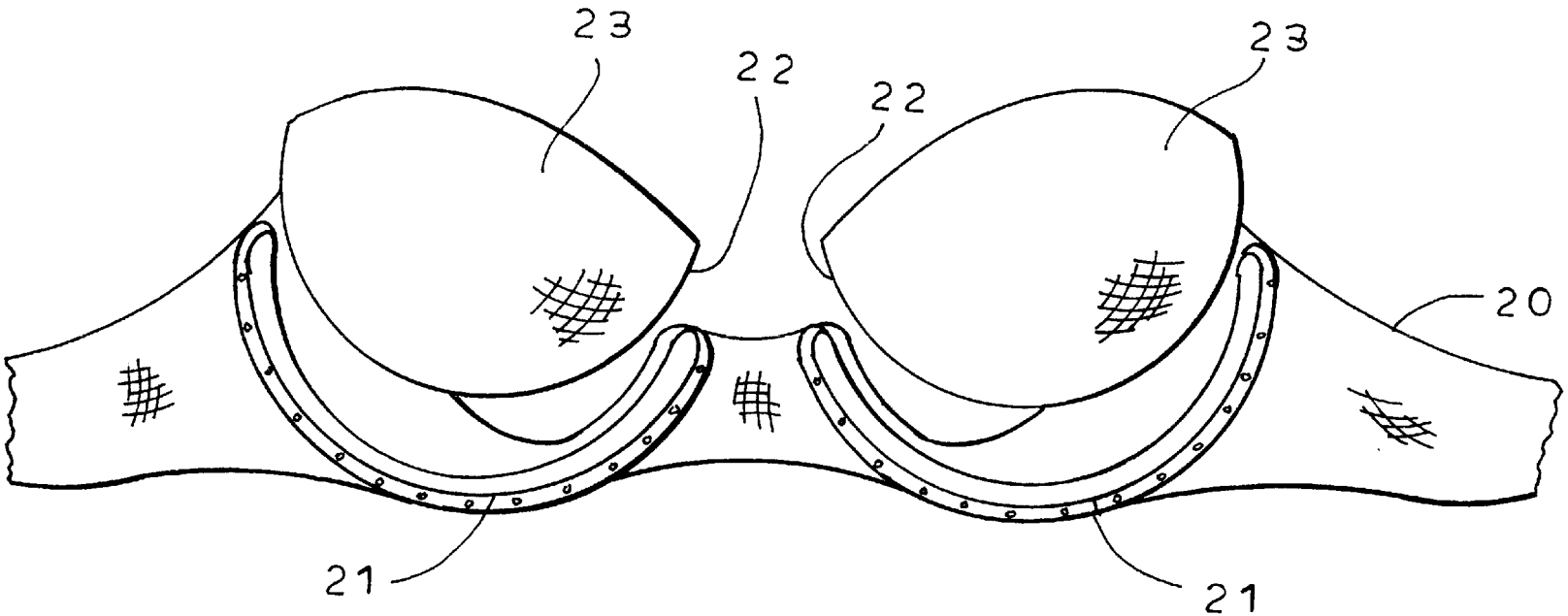
FIG. 2 is a view similar to FIG. 1 of a zip cup brassiere with a so-called hard frame.

In FIG. 2, a so-called hard frame 20 is provided in which the arcuate members 21 are in the form of channels in which the edges 22 of soft cups 23 can engage. Such a groove and rib arrangement is likewise found in the above-mentioned copending application. In both of these brassieres, the cups can be inserted onto the frame by sliding the lower edge of the cup on the arcuate frame member. If the cup is to be replaceable it can be removable by sliding in the opposite direction and, in that case, replacement cups can be provided with the brassiere or sold separately.

FIG. 3–10, however, are directed to a brassiere in which the underwire is formed by the means for connecting the cup to the frame as in FIGS. 1 and 2 and an improved docking system is provided for connecting the strap to the frame.

Figure 3:
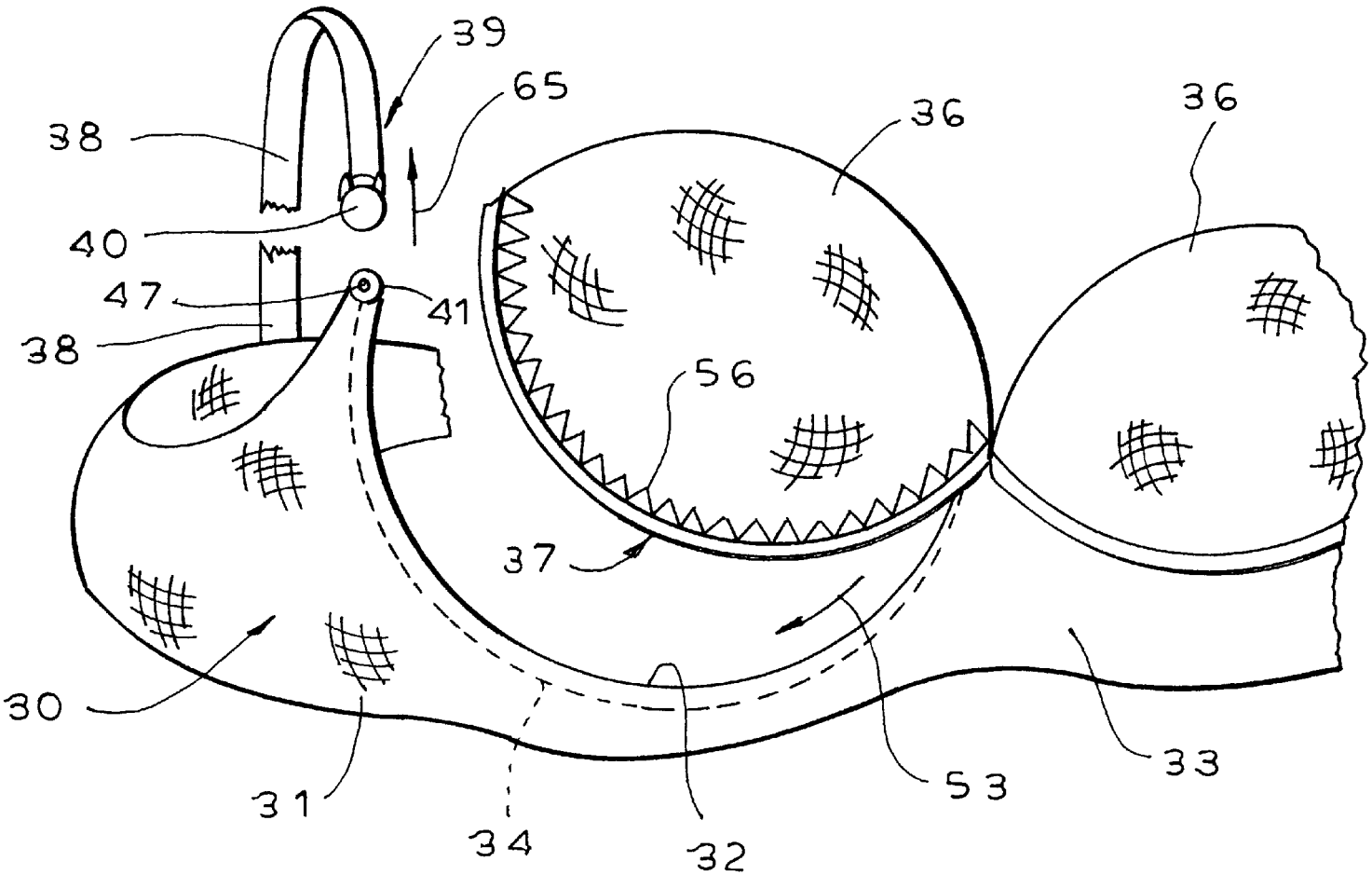
FIG. 3 is an elevational view with parts separated of a portion of a brassiere having a push and zip up wire assembly and illustrating the strap docking system of the invention.
Figure 4:
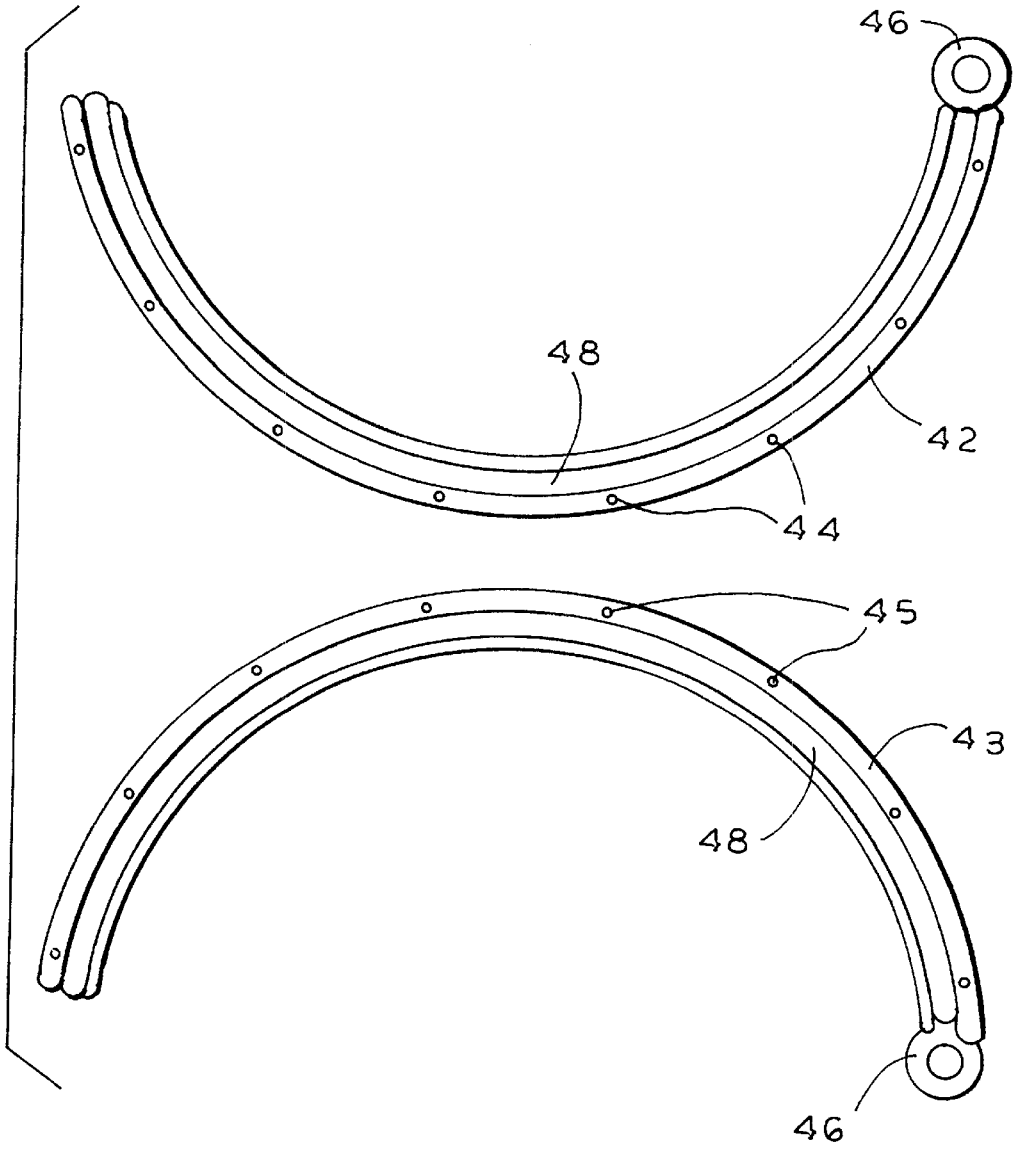
FIG. 4 is a view showing an elevation of the two parts of the channel portion of the assembly before ultrasonic welding of those parts together.
Figure 5:
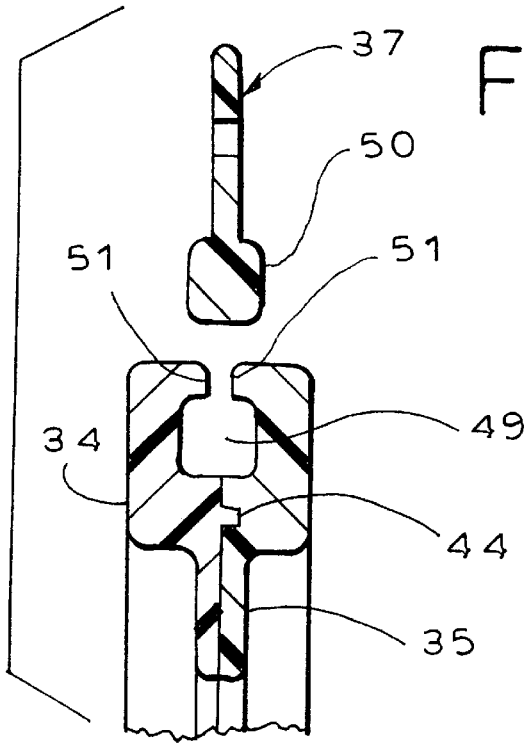
FIG. 5 is a cross sectional view of the assembly after welding of the channel.

As can be seen from FIG. 3, the frame of the brassiere 31 of the brassiere 30 has a pair of upwardly concave cup receiving portions 32 of flexible material, namely, the frame fabric, joined together at a mid-section 33 of the frame.

At each of the cup receiving portions, a respective upwardly concave curved channel 34 is attached to the frame, e.g. by ultrasonic welding or stitching and a flange 35 can be provided to facilitate this attachment. The channel is of greater rigidity than the material of the frame.

Respective brassiere cups 36 are adapted to be received in the cup receiving portions and have curved underwires 37 which are slidably insertable in the respective channel. Respective shoulder straps 38 are connected to each of the cup-receiving portions at the respective channel by docking systems represented generally at 39 and constituted of a shoulder strap link 40 and an eye 41 at the end of the respective channel remote from the mid-section 33.

Each of the channels 34 is assembled from a pair of injection molded parts 42, 43 one of which can be formed with registration pins 44 while the other has corresponding holes 45 receiving the pins in a press fit when the channel parts 42 and 43 are assembled together. The ends of the parts 42 and 43 may be formed with thin eyelet projections 46 which register with one another to form the eyelet 41 with its throughgoing hole 47. The two parts (see FIG. 5) are ultrasonically welded together by a horn-type apparatus or by a roller-type ultrasonic welder. The parts 42 and 43 are each formed with grooves 48 which register with one another to provide a channel 49 in which the head 50 of the underwire 37 can be received. Overhanging the channel 49 are ribs 51 which engage the bead 50 and resist transverse separation forces.

As can be seen from FIG. 36, the ends of the underwires 37 are formed with tips 52 facilitating the insertion of the underwire 37 into an open end of the channel 50 and thus sliding of the cup into the respective channel in the direction of arrow 53 to thereby secure the cup in the frame. The underwires 37 are more flexible in the channels 34 and are formed with sewing flanges 54 having a row of slots 55 to facilitate stitching of the underwire to the cup. The stitching is shown diagrammatically at 56 in FIG. 3. The slots can, of course, be omitted but do contribute to the flexibility of the rib which is inserted into the channel.

Figure 7:
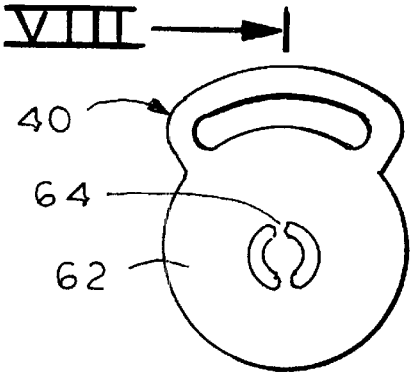
FIG. 7 is a rear elevational view thereof.
Figure 8:
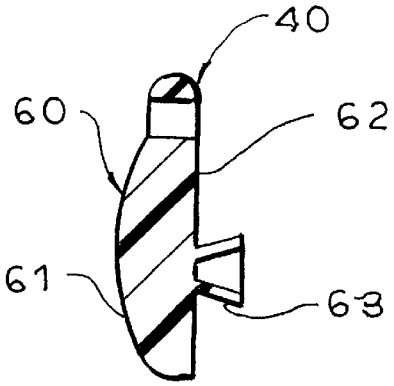
FIG. 8 is a cross sectional view along the line VIII—VIII of FIG. 7.
Figure 6:
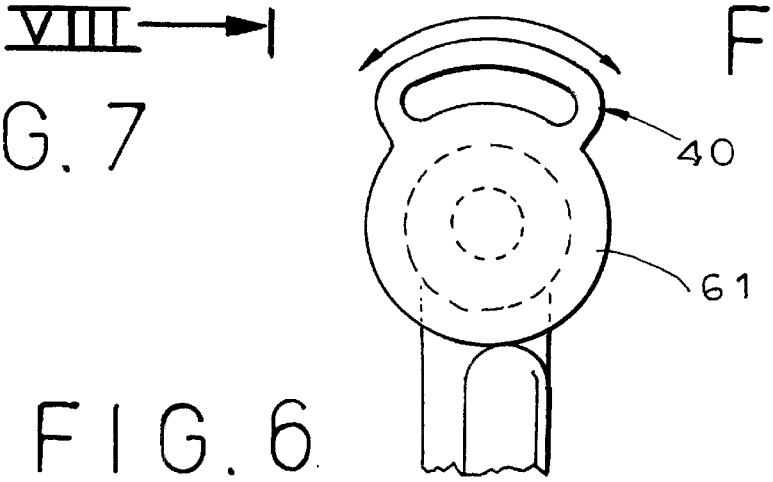
FIG. 6 is an elevational view of the press button link of the docking system.

In FIGS. 6–8, we have shown the link 40 in greater detail. The link 40 can comprise a push button shaped body 60 which is mounted convexly at its outer surface 61 and has a flat inner surface 62 from which a pin or stud 63 projects. This pin can widen outwardly and can be slotted at 64 to increase its flexibility. The pin 64 is dimensioned for a snap sit into the hole 47. Since the upward forces 65 applied by the strap to the eyelet 61 is transmitted directly to the channel 34, they provide an uplift or push from below against the respective cup 36 and do not, therefore, cause constriction of the cup or bunching of the cup fabric.

We claim:

1. A brassiere comprising:

a frame having a pair of upwardly concave cup-receiving portions of flexible material joined together at a mid-section of the frame;

a respective upwardly concave curved channel of greater rigidity than said material attached to said frame and extending along each of said upwardly concave cup-receiving portions;

a respective brassiere cup formed with a curved underwire slidably insertable in the respective channel, each underwire and the respective channel being shaped to resist transverse separation forces; and a respective shoulder strap connected to each of said cup-receiving portions at the respective channel.

2. The brassiere defined in claim 1 wherein each of said channels is provided with a shoulder-strap link at an end remote from the mid-section.

3. The brassiere defined in claim 2 wherein each of said links and the respective end of a respective channel are detachably interconnected by a press button assembly.

4. The brassiere defined in claim 3 wherein each of said press button assemblies comprises an eye and a male formation engaging in said eye.

5. The brassiere defined in claim 4 wherein each eye is provided on the respective end of the respective channel and the male formations are provided on button-shaped parts of the respective links.

6. The brassiere defined in claim 1 wherein each of said channels comprises two arcuate molded parts ultrasonically welded together.

7. The brassiere defined in claim 1 wherein each of said underwires is formed with a thin sewing flange through which the respective underwire is stitched to fabric of the respective cup.

8. The brassiere defined in claim 1 wherein each underwire is more flexible than the respective channel.

9. A brassiere comprising:

a frame having a pair of upwardly concave cup-receiving portions of flexible material joined together at a mid-section of the frame;

a respective upwardly concave curved channel of greater rigidity than said material attached to said frame and extending along each of said upwardly concave cup-receiving portions; and a respective brassiere cup formed with a curved underwire slidably insertable in the respective channel, each underwire and the respective channel being shaped to resist transverse separation forces, each of said channels comprising a pair of arcuate parts ultrasonically welded together.

10. The brassiere defined in claim 9 wherein each of said channels is provided with a shoulder-strap link at an end remote from the mid-section.

11. The brassiere defined in claim 10 wherein each of said links and the respective end of a respective channel are detachably interconnected by a press button assembly.

12. The brassiere defined in claim 11 wherein each of said press button assemblies comprises an eye and a male formation engaging in said eye.

13. The brassiere defined in claim 12 wherein each eye is provided on the respective end of the respective channel and the male formations are provided on button-shaped parts of the respective links.

14. The brassiere defined in claim 9 each of said underwires is formed with a thin sewing flange through which the respective underwire is stitched to fabric of the respective cup.

15. The brassiere defined in claim 14 wherein each of said sewing flanges is formed with array of slots along a length thereof.

16. The brassiere defined in claim 14 wherein each of said underwires is more flexible than the respective channel.

17. A method of making a brassiere comprising:

forming a frame having a pair of upwardly concave cup-receiving portions of flexible material joined together at a mid-section of the frame;

molding a pair of arcuate parts and ultrasonically welding the parts of each pair of acurate ...parts together to form a respective upwardly concave curved channel of greater rigidity than said material, and attaching the respective channel to said frame along each of said upwardly concave cup-receiving portions; and providing a respective brassiere cup with a curved underwire slidably insertable in the respective channel, each underwire and the respective channel being shaped to resist transverse separation forces.

18. The method defined in claim 17, further comprising the step of detachably connecting a shoulder strap to a respective end of the respective channel remote from the mid-section.

19. The method defined in claim 18 wherein each shoulder strap is connected to the respective end of the respective channel by snap fitting a press button link into an eye formed on the respective channel.

20. The method defined in claim 17 wherein each underwire is formed with a respective sewing flange, further comprising stitching each underwire to the respective cup through the respective flange.

* * * * *